United States Patent [19]

Bowditch

[11] Patent Number: 4,457,243

[45] Date of Patent: Jul. 3, 1984

[54] AUTOMATED SEAM JOINING APPARATUS

[75] Inventor: Philip N. Bowditch, Cohasset, Mass.

[73] Assignee: The Charles Stark Draper Laboratory, Inc., Cambridge, Mass.

[21] Appl. No.: 345,756

[22] Filed: Feb. 4, 1982

[51] Int. Cl.[3] ..... D05B 3/00; D05B 27/10

[52] U.S. Cl. ..... 112/121.14; 112/304; 112/311

[58] Field of Search ..... 112/121.14, 2, 121.15, 112/121.12, 121.26, 304, 311, 303

[56] References Cited

U.S. PATENT DOCUMENTS

| | | | |
|---|---|---|---|
| 1,812,368 | 6/1931 | Popkin | 112/121.14 |
| 2,297,295 | 9/1942 | Flintjer | 112/304 X |
| 3,395,658 | 8/1968 | Lee et al. | 112/121.14 |
| 3,469,545 | 9/1969 | Hale et al. | 112/304 X |
| 3,496,891 | 2/1970 | Kosrow et al. | 112/304 X |
| 3,800,719 | 4/1974 | Rockerath | 112/304 |
| 3,839,973 | 10/1974 | Cummins et al. | 112/121.14 |
| 3,871,312 | 3/1975 | Rockerath et al. | 112/304 |

*Primary Examiner*—H. Hampton Hunter
*Attorney, Agent, or Firm*—Lahive & Cockfield

[57] ABSTRACT

Disclosed is a system for automated joining of limp fabric or material. The system comprises a movable seam joining device, retractable belt assemblies to capture the fabric, and a controller to achieve proper positioning of the seam joining device and the retractable rollers.

8 Claims, 5 Drawing Figures

AUTOMATED SEAM JOINING APPARATUS

REFERENCE TO RELATED APPLICATIONS

The subject matter of this application is related to that of my U.S. patent application Ser. No. 231,381, entitled "System and Method for Manufacturing Seamed Articles" and filed on Feb. 4, 1981 now U.S. Pat. No. 4,401,044. That application is incorporated herein by reference.

BACKGROUND OF THE INVENTION

This invention relates to the joining or stitching of limp fabric or material to form useful articles. In particular, the invention relates to apparatus useful in automated or computer-controlled sewing of fabric.

Classic assembly line manufacture of articles constructed of limp fabric consists of a series of manual operator-controlled assembly stations. One drawback of this classic fabrication technique is that it is labor intensive; that is, a large portion of the cost of manufacture is spent on labor. To reduce costs, automated or computer-controlled manufacturing techniques have been attempted. One such method is disclosed in U.S. application Ser. No. 231,381, previously incorporated herein by reference.

In general, automated manufacturing techniques for limp fabric are limited to problems caused by inaccurate joining of the fabric at the seams. This problem can be traced to the failure of most automated systems to have sufficient control of the fabric near the needle or joining head. In manual operator-controlled assembly, the proper fabric control is achieved by pressure of the operator's fingers or, in certain limited instances, a jig specific edge reference local aligner mechanism has been utilized to supply the proper pressure. To date, the mechanical devices such as the local aligner mechanism have not been sufficiently adaptable for use by automated systems in forming complex joining patterns.

SUMMARY OF THE INVENTION

This invention comprises an apparatus for automated joining of material, particularly limp fabric, wherein the material to be joined is held under proper control and alignment for formation of an optimum seam. The system comprises means for advancing along a first axis and positioning the material so proper orientation and control is achieved. The system also comprises a sewing head and bobbin which move along a second axis transverse to the direction of the advancing material and cause the actual joining of the material. The sewing head and bobbin position along that second axis is determined by a controller which also issues commands to the material advancing system. The material advancing system comprises a first base assembly and a second base assembly adapted to permit frictionally coupled motion of the material. The system further comprises a circularly slotted plate which, in conjunction with the material surfaces of the base assemblies, forms a substantially continuous composite surface which defines one side of a material passage. A plurality of pairs of belt assemblies are opposite the composite surface and define the second side of the material passage. The belts of the pairs are disposed along assembly axes parallel to the first axis. Each of the belt assemblies includes a belt adapted for frictionally engaging the material. At least one of each pair of belt assemblies includes a controllable belt, at least four rollers, and a belt controller. The belt controller positions the rollers through a mechanical linkage whereby the belt is advanced to overlap a portion of a gap region of the composite surface extending along the second axis, or retracted so it does not overlie that gap region. The controller which positions the seam joining device also controls the belt controller so that as the seam joining device is positioned along the second axis, one or both belts of the pair adjacent to the seam joining device retracts while the belts of the other pairs are in their non-retracted state. Each belt assembly can be given separate commands.

The plate is coupled to the bobbin assembly of the seam joining device. The circular slot in the plate is sufficiently large to permit passage of a needle of the sewing head. The material surfaces of the base assemblies may be defined by a substantially planar slide with a plurality of slots having an associated plurality of belts passing through the slots to frictionally engage the material. The invention also contemplates having independent control of all the belts defining the material passage.

Accordingly, it is an object of the invention to provide an automated seam joining system. It is another object of the invention to provide an apparatus for producing seamed articles controllable by an external programmable device.

These and other objects and features of the invention will be apparent from the following description of the preferred embodiment and from the drawing.

DESCRIPTION OF THE PREFERRED EMBODIMENT

The present invention discloses an apparatus for improved automated joining of material such as limp fabric. The apparatus is particularly useful in conjunction with a method for producing continuous web seamed articles such as is disclosed in U.S. application Ser. No. 231,381, previously incorporated herein by reference. The apparatus provides a means for supplying the proper orientation and control to limp fabric near the seam joining device so it may be joined without the necessity of manual operator stations. Using this apparatus, even complex patterns such as embroidery may be generated without requiring manual intervention. The apparatus also provides means for supplying the proper orientation and control to limp fabric or material at positions away from the sewing head so that the problems of bunching or uneven sewing are minimized, and desired easing may be accomplished. Moreover, when used in conjunction with the system disclosed in the incorporated reference, the material being sewn may readily be oriented to permit joining of the various seams.

Figure 1:
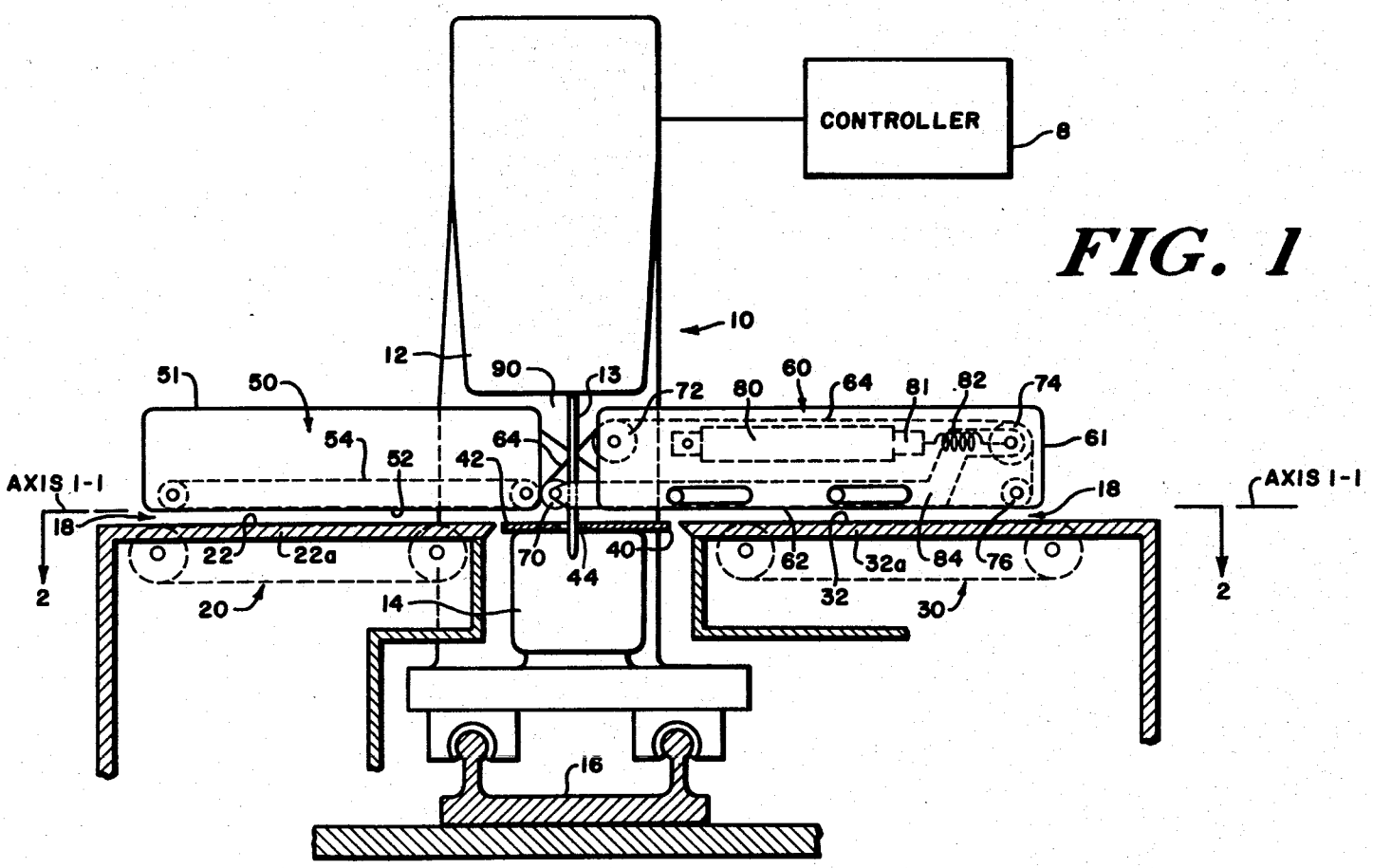
FIG. 1 illustrates a sectional view of the material advancing system.

Referring to the drawing, FIG. 1 shows a sectional view of the total system including an associated controller 8. The material is advanced along a first axis 1—1 to reach the proper joining position. Seam joining device 10, comprising a sewing head 12 including a needle 13 on one side of a material passage 18 and a bobbin assembly 14 on the opposite side of material passage 18, is constrained to move on a track 16 surrounding a second axis 2—2 transverse to first axis 1—1. Seam joining device 10 is responsive to control signals from a controller 8 which positions seam joining device 10 along track 16.

The material advancing and positioning portion of the system includes a first base assembly 20 having a material surface 22 adapted to permit motion of material frictionally coupled thereto in the direction of first axis 1—1. A second base assembly 30 having a material surface 32 adapted to permit motion of material frictionally coupled thereto in the direction of first axis 1—1 is on the same side of material passage 18 as first base assembly 20. A plate member 40 coupled to bobbin assembly 14 having a substantially planar material surface 42, is on the same side of material passage 18 as first base assembly 20 and second base assembly 30. Plate member 40 has a circular slot 44 (see FIG. 4) positioned such that needle 13 of sewing head 12 may pass through slot 44. Means are provided to position material surface 22, material surface 32, and material surface 42 to define a continuous composite material surface forming one side of material passage 18.

Figure 2:
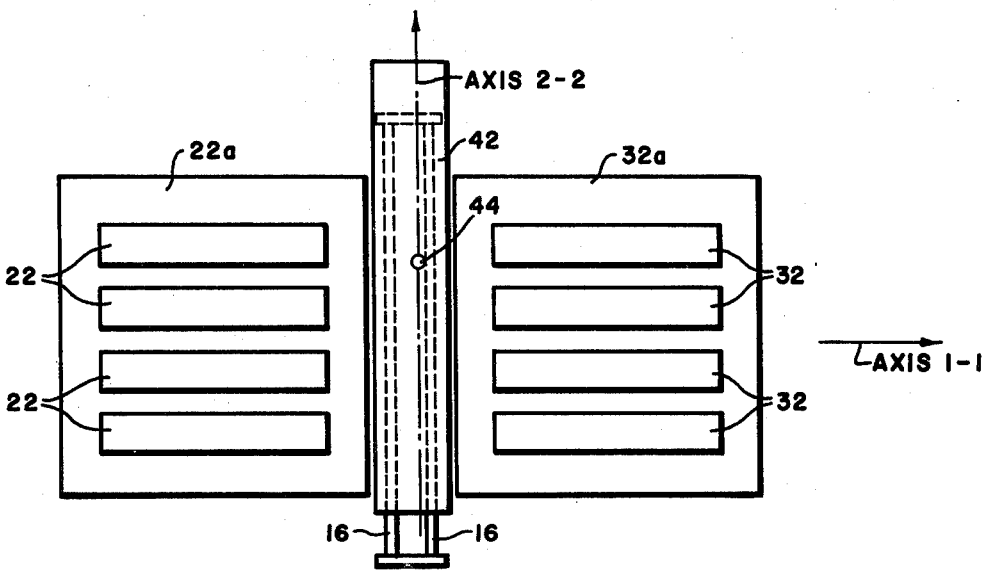
FIG. 2 is a plan view of the composite material surface of the system of FIG. 1.

FIG. 2 shows a plan view of the portion of the system of FIG. 1 below passage 18, the system wherein the material surfaces 22 and 32 are upper surfaces of a plurality of belts adapted for controlled motion in the direction of axis 1—1. Belts 22 and 32 are surrounded by slide plates **22*a* and 32*a* respectively, which provide substantially friction-free support of material in passage 18**.

The side of material passage 18 opposite the composite material surface is formed by the lower portions of a plurality of pairs of belt assemblies on opposite sides of the locus of device 10. Each pair of belt assemblies is disposed along an associated assembly axis parallel to axis 1—1. In FIG. 1, the end-most pair of belt assemblies 50 and 60 are shown with end plates 51 and 61, respectively. Belt assemblies 50 and 60 include belts 54 and 64, respectively, having belt surfaces 52 and 62 opposite the composite material surface and adapted for motion in the direction of first axis 1—1. Belt surfaces 52 and 62 are adapted for frictional engagement with the material adjacent thereto and, together with material surfaces 22, 32 and 42, define material passage 18.

Figure 3A:
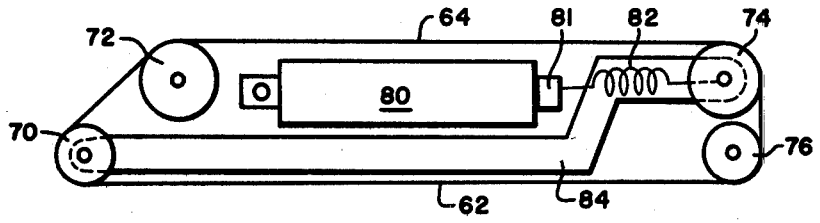
FIGS. 3A and 3B are sectional views of a controllable belt member of a belt assembly pair of the system of FIG. 1.
Figure 3B:
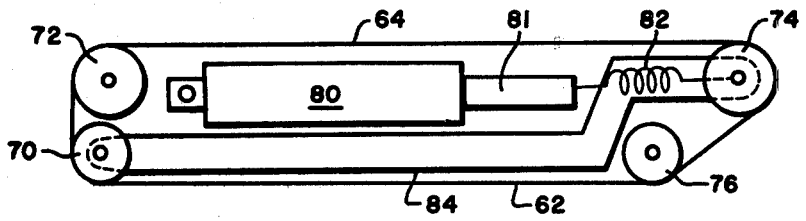

FIGS. 3A and 3B illustrate a sectional view of a preferred embodiment of first belt assembly 60. Belt 64 of first belt assembly 60 is a controllable belt disposed about four rollers 70, 72, 74 and 76. Rollers 70 and 74 are movable while rollers 72 and 76 are fixed. In a most preferred embodiment, roller 76 is a driver while rollers 70, 72 and 74 are idlers. A controller of first belt assembly 60 controls the position of a positioning device 80, preferably a pneumatic cylinder, having a coupler 81 which is movable in the direction of axis 1—1. In the present embodiment, the cylinder includes a double action pneumatic piston, for example a model 8-DP-11/2 manufactured by Humphrey, Inc., Kalamazoo, Mich. A shuttle arrangement (not shown) selectively applies a controlled high pressure air plenum to the respective ones of the cylinders in step with the motion of the seam joining device along axis 2—2 to retract the belts adjacent to the seam joining device, while a low pressure air plenum supplies pressure to all other cylinders ensuring their overlapping characteristic. In other embodiments, an electronic controller may be used under the control of controller 8.

Coupled to movable coupler 81 is a rigid positioning frame 84 attached to movable roller 70 and, coupled through a spring 82, attached to movable roller 74. When positioning device 80 receives commands from the belt controller, positioning device 80 causes movable coupler 81 to move thereby moving positioning frame 84. The coupled motion of positioning frame 84 moves rollers 70 and 74 to change the shape of controllable belt 54, without changing the speed of the belt relative to the material passage 18. In a first state, illustrated by FIGS. 1 and 3A, belt 64 advances to be adjacent to its opposing belt 54. In a second state, illustrated by FIG. 3B, belt 64 retracts so it establishes a gap 90 between belts 54 and 64 to permit passage of needle 13 therethrough. Gap 90 is the space between the respective pairs of belt assemblies when the belts are in their second or retracted state. The controller for first belt assembly 54 is linked to the controller for seam joining device 10 so there is corresponding motion between seam joining device 10 and positioning device 80. A single computer may act as controller for seam joining device 10 and positioning device 80.

Figure 4:
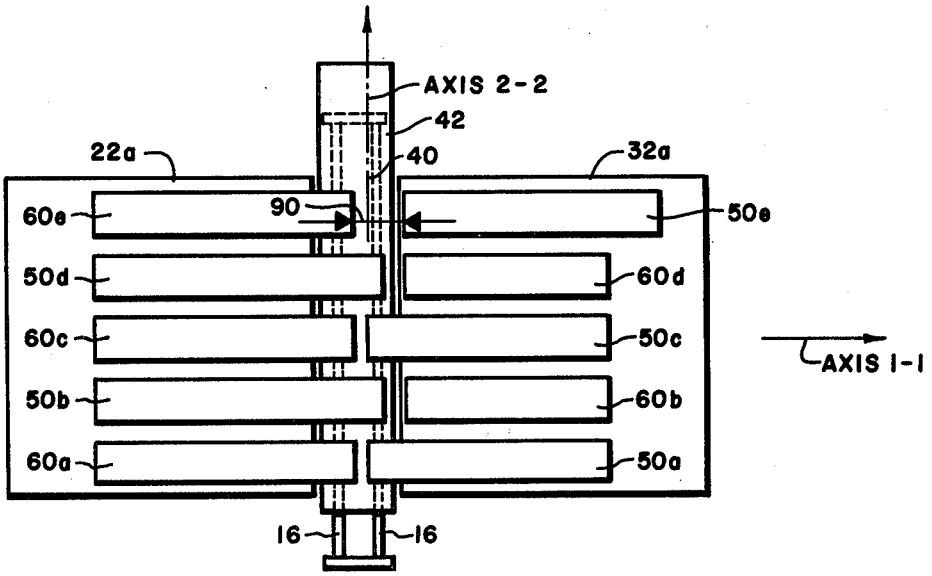
FIG. 4 is a top view of the system of FIG. 1, not including the sewing head.

FIG. 4 shows a plan view of a plurality of upper belt assemblies clearly showing gap 90 between belt **60*e* and retracted belt 50*e*. Second axis 2—2, transverse to the first axis 1—1**, has been labelled in this figure.

In FIG. 4, belt assemblies **50*a*, 50*b*, 50*c*, 50*d* and 50*e* are retractable (i.e. as shown in FIGS. 3A and 3B), while belt assemblies 60*a*, 60*b*, 60*c*, 60*d* and 60*e* all have fixed axis rollers. Belt assembly 50*e* is in its retracted state to permit passage of needle 13 between the belts of assemblies 50*e* and 60*e***. The other retractable belt assemblies are in their non-retracted states. In the illustrated embodiments, only one belt of each pair is retractable, but in other embodiments both may be retractable.

In one preferred embodiment, as in FIG. 1, plate member 40 is attached to bobbin assembly 14 so there is corresponding movement of plate member 40 and bobbin assembly 14. In some embodiments, rotatable feed dogs may extend through plate member 40 to assist in positioning the material to be joined.

In operation, material, particularly limp fabric, is advanced in material passage 18 to reach the proper positioning for joining. The material is frictionally driven by drive belts comprising material surfaces 22 and 32 and belt surfaces 52 and 62. It is possible that any or all of these frictionally coupled surfaces promote transit of the material through material passage 18. When seam joining device 10 receives a command from its controller, it moves along track 16 to a particular position. At the same time, commands are issued by the belt controller to each of the belt assemblies. The belt assembly whose assembly axis coincides with the position set forth for seam joining device 10 will receive the command to move from first state to second state, thereby retracting its belt from gap 90 and allowing seam joining device 10 to position itself in the gap. At the same time, the other belt assemblies will receive a command to either move to or stay in the first state, thereby effectively capturing the limp fabric so as to achieve the proper control. As seam joining device 10 receives new commands, so do the belt assemblies.

In various embodiments, the material in passage 18 may be folded to be double thickness and the belts may be controlled to move one layer with respect to another to align desired curvilinear segments for forming a seam. By specific commands to the belt assemblies, easing may be accomplished. This apparatus is particularly well adapted to methods such as the sew-before-cut, continuous web method disclosed in U.S. application Ser. No. 231,381, previously cited. Since all the commands are issued by the controller, and proper control is achieved through the use of the retracting and advancing belts, operator intervention should be minimal. Complex patterns of joining, including embroidery, can be used by proper programming of the controller.

The invention may be embodied in other specific forms without departing from the spirit and scope thereof. Accordingly, other embodiments are within the following claims.

What is claimed is:

1. A system for advancing material along a first axis with respect to a seam joining device, said seam joining device being responsive to control signals to selectively move along a second axis, said second axis being transverse to said first axis, said seam joining device including a sewing head on one side of said material in a material passage and a bobbin assembly on the other side of said material passage, said system comprising:

A. a first base assembly on a first side of said material and including a material surface adapted to permit motion of material frictionally coupled thereto in the direction of said first axis, B. a second base assembly on said first side of said material and including a material surface adapted to permit motion of materials frictionally coupled thereto in the direction of said first axis, C. a plate member having a substantially planar material surface, said material surface and said plate member including a circular slot therein adapted for the passage therethrough of the needle of said sewing head, D. means for positioning said first and second base assemblies whereby said material surfaces of said first and second base assemblies and said material surface of said plate member form a continuous composite material surface defining one side of said material passage, E. a plurality of pairs of belt assemblies opposite said composite surface and defining the second side of said material passage, wherein each of said belt assemblies includes a belt having a belt surface portion opposite said composite material surface and adapted for motion in the direction of said first axis, said belt surface being adapted for frictional engagement with material adjacent thereto, wherein the belt assemblies of each of said pairs are disposed along an associated assembly axis, said assembly axis being parallel to said first axis, wherein at least one belt assembly of each of said pairs includes a controllable belt disposed about at least four rollers, and two of said rollers are positioned whereby the outer surface of said belt is positioned opposite to a portion of said composite surface, and further includes:

belt control means for selectively controlling the position of predetermined ones of said rollers whereby in a first state said belt overlaps a portion of a gap region of said composite surface extending along said second axis, and in a second state said belt is retracted and does not overlie said gap region, F. a controller including means responsive to said control signals for selectively controlling said belt control means whereby said controllable belts are in said second state whenever said seam joining device is at a position along said second axis proximate to said assembly axis, and whereby said controllable belts are in said first state otherwise.

2. A system according to claim 1 wherein said plate member is coupled to said bobbin assembly.

3. A system according to claim 1 wherein the material surfaces of said first and second base assemblies are defined by a substantially planar slide member having a plurality of slots therein, said slots extending in the direction of said first axis, and are further defined by portions of the outer surface of an associated plurality of belts extending through the respective ones of said plurality of slots.

4. A system according to claim 1 further comprising a control means for each of said belts, said controller including means for controlling belt motion to provide selectively controlled motion of material adjacent to and frictionally coupled to the respective belt portions defining said material passage.

5. A system according to claim 1 wherein said plate member is bounded in part by substantially straight and parallel edges.

6. A system for orienting a strip of material with respect to a linear movable seam joining head, comprising:

at least two sets of opposed belts and associated support structures on each side of the locus of said seam joining head, wherein the opposing surfaces of each of said belts are adapted to frictionally engage an adjacent surface of said material, and wherein one or more of said support structures are two state support structures including means responsive to applied control signals, including means for selectively controlling its associated belt to be in a first state in part overlying an associated portion of the locus of said seam joining head or in a second state outside the locus of said seam joining head, and further including a controller adapted to generate said control signals whereby each two state support structure is controlled to be in its first state when said seam joining head is positioned outside the portion of said locus associated with that belt, and to be in its second state when said seam joining head is positioned at least in part within said portion.

7. A system according to claim 6 wherein each of said two state support structures includes at least four rollers supporting its associated belt, wherein at least two non-adjacent ones of said rollers are fixed with respect to said locus, and at least two other are selectively movable in concert with respect to said locus.

8. A system according to claim 6 wherein each of said two state support structures includes a selectively controlled pneumatic cylinder adapted to move said two other rollers to provide said first and second state belt positionings.

* * * * *